United States Patent [19]

Speegle et al.

[11] 4,452,311

[45] Jun. 5, 1984

[54] EQUALIZING MEANS FOR WELL TOOLS

[75] Inventors: Steven C. Speegle, Flower Mound; Michael B. Vinzant, Carrollton, both of Tex.; Vinson D. Sullivan, Houma, La.

[73] Assignee: Otis Engineering Corporation, Dallas, Tex.

[21] Appl. No.: 423,151

[22] Filed: Sep. 24, 1982

[51] Int. Cl.[3] ..... E21B 34/10; E21B 43/12

[52] U.S. Cl. ..... 166/324; 166/332; 166/72; 137/629

[58] Field of Search ..... 166/324, 332, 320, 321, 166/316, 373, 374, 375, 327, 328, 329, 72; 137/629

[56] References Cited

U.S. PATENT DOCUMENTS

| | | | |
|---|---|---|---|
| 2,663,545 | 12/1953 | Grable | 166/332 |
| 3,071,151 | 1/1963 | Sizer | 166/324 |
| 3,078,923 | 2/1963 | Tausch | 166/324 |
| 3,273,649 | 9/1966 | Tamplen | 166/332 |
| 3,583,442 | 6/1971 | Dollison | 166/324 |
| 3,696,868 | 10/1972 | Taylor, Jr. | 166/375 |
| 3,703,193 | 11/1972 | Raulins | 166/324 |
| 3,731,742 | 5/1973 | Sizer et al. | 166/375 |
| 3,799,204 | 3/1974 | Watkins et al. | 166/324 |
| 3,799,258 | 3/1974 | Tausch | 166/72 |
| 3,826,462 | 7/1974 | Taylor | 166/324 |
| 3,845,818 | 11/1974 | Deaton | 166/324 |
| 3,854,502 | 12/1974 | Mott | 166/324 |
| 3,860,066 | 1/1975 | Pearce et al. | 166/72 |
| 3,865,141 | 2/1975 | Young | 137/629 |
| 3,999,574 | 12/1976 | Ott | 166/324 |
| 4,103,744 | 8/1978 | Akkerman | 166/324 |
| 4,140,153 | 2/1979 | Deaton | 137/629 |
| 4,149,698 | 4/1979 | Deaton | 166/324 |

*Primary Examiner*—Ernest R. Purser
*Assistant Examiner*—Hoang C. Dang
*Attorney, Agent, or Firm*—Albert W. Carroll

[57] ABSTRACT

Pressure equalizing means for well tools having a tubular housing and an operator tube movable longitudinally therewithin, there being provided a valved bypass passage in the housing and a shoulder on the operator tube for engaging and opening the valve of the valved bypass passage upon longitudinal movement of the operator tube in the housing, the equalizing mechanism further including a pair of seal rings sealing between the housing and the operator tube above and below the valved bypass passage in the housing and a lateral passage in the wall of the operator tube normally above the pair of seals but movable under no-flow conditions with the operator tube to a position between the pair of seals prior to the operator tube shoulder contacting the valve of the bypass passage, thus avoiding damage to or flow cutting of the seals which normally form a secondary seal to provide bubble-tight integrity even if the valve in the bypass passage does not seal bubble tight.

19 Claims, 9 Drawing Figures

EQUALIZING MEANS FOR WELL TOOLS

BACKGROUND OF THE INVENTION

1. Field of the Invention

This invention relates to well tools and more particularly to means for equalizing pressures across well tools such as downhole safety valves, regulators, plugging tools, and the like devices.

2. Description of the Prior Art

Many well tools, such as tubing downhole safety valves, plugging tools, flow regulators, or the like, are installed in flow conductors of wells such as oil and gas wells by well-known means such as wireline tools, or the like, to control the flow of fluids therethrough. When it is desired to remove such a well tool from a well, the well is closed in to stop flow therefrom and facilitate the safe removal operation. Such well tools will generally hold back well pressure beneath, and often a great differential pressure will develop thereacross and must be equalized prior to removal from the well lest when the well tool is unlocked for removal, this differential pressure violently force the well tool and the wireline tools upwardly in the flow conductor. When this occurs, the tools generally become entangled in the wire, causing a long and expensive fishing job and loss of production.

Most such well tools or flow control devices include a seat and cooperative valve closure member. The valve closure is usually actuated between open and closed positions by an operator tube which is relatively longitudinally movable within the valve housing or body. In many such valves, this relative longitudinal movement of the operator tube also operates an equalizing mechanism so that pressure may be equalized across the valve closure prior to opening the valve and releasing it for removal from the well. In some tools, the equalizing mechanism is provided in a separate sub usually included between the flow control device and the locking device from which it is suspended in the well.

The following prior art U.S. patents were found in a search.

U.S. Pat. Nos. 3,071,151, 3,703,193, 3,845,818, 3,078,923, 3,731,742, 3,860,066, 3,273,649, 3,799,204, 3,865,141, 3,583,442, 3,799,258, 4,140,153, 3,696,868, 3,826,462, and 4,149,698.

Of these prior art patents, U.S. Pat. Nos. 3,860,066; 3,583,442; 3,696,868; 3,731,742; 3,826,462; 4,140,153; and 4,149,698 disclose well tools having a common type of equalizing valve. U.S. Pat. No. 3,860,066 is typical of this group.

U.S. Pat. No. 3,860,066 issued to Joseph L. Pearce, et al. on Jan. 14, 1975 discloses a safety valve in which a main valve and operator tube are disposed in a housing. The main valve cooperates with a seat surface surrounding the lower end of the bore through the operator tube and is movable in response to longitudinal movement of the operator tube between open and closed positions to control flow therethrough. An enlargement having an annular upwardly facing seating surface thereon is formed on the operator tube and engages an annular downwardly facing seating surface in the housing when the operator tube is in its upper or valve closed position to prevent fluid pressure bypassing the valve. These seat surfaces are hard and are subject to leaking.

A lateral equalizing aperture above the enlargement allows fluid pressure from below the valve to bypass it and enter the operator tube when the operator tube is depressed a little and the annular seats are disengaged.

This U.S. Pat. No. 3,860,066 also shows, in FIGS. 2, 3, and 4, that an operator tube which is longitudinally movable in a housing can be utilized to operate at least three types of main valves, namely, ball type, poppet type, and flapper type.

U.S. Pat. No. 3,703,193 which issued to George M. Raulins on Nov. 21, 1972 discloses a safety valve much like that just discussed but including a lost-motion connection incorporated in the operator tube between the main seat surface and the external equalizing seat surface. Thus, to open the valve, the operator tube is moved down a little to unseat the equalizing seating surfaces to permit equalizing of pressures. Afterwards, further downward movement of the operator tube is utilized to move the main valve to its open position. The seat surfaces in this valve also are hard and are subject to leaking.

U.S. Pat. No. 3,845,818 issued to Thomas M. Deaton on Nov. 5, 1974 and shows a safety valve having a housing, a flapper valve in the housing and an operator tube for moving the flapper valve to open position. The operator tube has an annular equalizing valve closure means on its exterior which engages an annular downwardly facing seat surface when the operator is in its upper position to prevent bypass of fluid pressure around the closed flapper valve. When the operator tube is depressed and the equalizing seating surfaces are disengaged, bypass fluid flow may occur through a lateral port in the housing, down through the equalizing valve mechanism, and through a lateral port in the operator tube, near its lower end. This is essentially an inversion of the equalizing means discussed above with respect to U.S. Pat. No. 3,860,066. The device of U.S. Pat. No. 3,845,818 has resilient seal rings which seal bubble tight, but the seal is broken before the equalizing valve is opened.

U.S. Pat. No. 3,799,204, issued Mar. 26, 1974 to Fred E. Watkins, and U.S. Pat. No. 3,799,258, issued also on Mar. 26, 1974 to Gilbert H. Tausch, disclose safety valves incorporating equalizing valves which operate much like that disclosed in U.S. Pat. No. 3,845,818, just discussed. The device disclosed in this patent has hard seats with a soft seal built into one of them. The seal is subject to being washed out of place as soon as the seal surfaces are disengaged.

U.S. Pat. No. 3,865,141, which issued to David E. Young on Feb. 11, 1975, discloses a safety valve having an equalizing valve in the operator tube. The operator tube has telescoping sections. When the operator tube is extended, the equalizing valve is closed. When it is telescoped or shortened, the seal is disengaged, and equalization of pressures can take place as a result of fluid flow therethrough.

U.S. Pat. No. 3,078,923 issued Feb. 26, 1963 to Gilbert H. Tausch and discloses a well safety valve having equalizing means which appears to be the showing most pertinent to the present invention. This patent shows a housing, a flapper valve in the housing, a lateral equalizing port above the flapper valve, and a spring-loaded equalizing valve closure in said port and having a portion thereof protruding into the bore of the housing. An operator tube is disposed for relative longitudinal movement in the housing. When the operator tube is in its upper position (see FIG. 3), its lower end clears both the flapper valve and the equalizing valves and allows them to be closed by their springs. To open the valve, the operator tube is depressed. It first engages and opens the equalizing valve and may apply an opening bias to the flapper valve. When equalization of pressures across the closed flapper has occurred, or nearly so, the operator tube will move further downwardly and will move the flapper valve to open position. The equalizing valve is opened before the flapper valve is opened and will remain open all the while that the flapper valve is open, allowing the well to be produced. The equalizing valve, being thus open during normal production, is vulnerable to being fouled with trash or detritis collecting therein. It is also subject to flow cutting and subsequent leaking when the flapper valve is closed and the safety valve is so desperately needed to hold against well pressure and perhaps prevent a disastrous blowout.

U.S. Pat. No. 3,071,151 which issued to Phillip S. Sizer on Jan. 1, 1963 shows an equalizing sub used in conjunction with a downhole safety valve. This equalizing sub has an equalizing valve built into a lateral aperture in the wall thereof and is structured almost identical to the equalizing valve built into the safety valve of U.S. Pat. No. 3,078,923, supra. The equalizing sub of U.S. Pat. No. 3,078,923 is shown on page 3908 of the Catalog of Oilfield Equipment and Services, 1962–63 Edition, where it is identified as the Type B or Type F Otis Equalizing Sub. The valves in these subs are actuated by a prong such as the Type "P" Prong illustrated on page 3938 of the same catalog. On page 3908 there is also illustrated the Type G Otis Equalizing Sub. While the Type B (or H) Otis Equalizing Sub has a poppet type valve with a metal-to-metal seal, the Type G Otis Equalizing Sub has a sleeve valve with resilient seals. The metal-to-metal seal is subject to leaking, and the resilient seals for the sliding sleeve valve are soon cut if the sleeve's port is moved past the seal while a pressure differential exists thereacross.

U.S. Pat. No. 3,273,649 which issued to Jack W. Tamplen on Sept. 20, 1966 discloses another type of equalizing sub. Tamplen's equalizing sub, also, has a sleeve valve actuable to open position by a prong, but when the prong is withdrawn from the device, it will return the sleeve valve to closed position and leave it there.

The present invention overcomes most of the problems associated with the equalizing mechanisms of the type found in the prior art discussed hereinabove by providing soft seals to form a bubble-tight bridge across the equalizing valve proper when the device is in closed position and then breaking this bridge just prior to opening the equalizing valve to permit flow therethrough.

SUMMARY OF THE INVENTION

The present invention is directed to devices for use in flow conductors such as the tubing of oil and gas wells, this device having a tubular housing, an operator tube in the housing slidable longitudinally relative thereto, and an equalizing valve mechanism carried by the housing and operable by engagement by a shoulder or the like carried on the operator tube to permit fluids to enter the device and equalize pressures therewithin and without preparatory to release and removal of the device from the well, there being provided in this device, seals sealing between the housing and the operator tube above and below that part of the equalizing valve which is engageable by the shoulder on the operator tube, and there being provided an equalizing passage through the wall of the operator tube which is above the seals when the operator tube is in its upper position, and being movable to a location between the seals and in communication with the equalizing valve prior to the equalizing valve being moved from closed towards open position. While the equalizing mechanism of this invention is particularly suited for use in downhole safety valves which are operated from the surface, it also finds utility in an equalizing sub which can be included between a locking device and any suitable flow control device, such as for instance, a downhole safety valve which is not controlled from the surface, or a plug or pressure regulator, or the like. In this form, the equalizing mechanism is operable by a prong lowered into the well on a wire line and inserted in the device to move the valve therein to open position.

It is therefore one object of this invention to provide a flow control device for wells having equalizing means for equalizing pressures across such device preparatory to releasing it from anchored engagement with the well flow conductor.

Another object is to provide a well flow control device such as a well valve, or the like, with equalizing means for opening a bypass passage therethrough to permit differential pressures thereacross to be reduced, thus reducing the force required to subsequently open such well valve, or the like.

Another object is to provide such a device with equalizing means such as that described which is operated automatically during the retrieval sequence.

Yet another object of this invention is to provide a simple equalizing valve in a well tool in which an internal sleeve member is longitudinally movable in an outer housing, the equalizing valve being disposed in an aperture in the housing and having a portion thereof projecting inside the housing and being engageable by the internal sleeve which when depressed will engage and open the equalizing valve.

Another object is to provide such an equalizing valve having non-resilient seal surfaces, such as provided by a simple ball and seat, and providing a pair of seals to seal above and below the equalizing valve to render any leakage thereof inconsequential, but also providing a lateral passage in the wall of the internal sleeve which is positioned above the upper one of this pair of seals when the main valve is closed but is movable past said upper seal to a position between said pair of seals and into communication with said equalizing valve upon downward movement of said inner sleeve.

Another object is to provide a device of the character just described wherein as said inner sleeve is moved downwardly, the equalizing passage in the wall of the inner sleeve is moved past the upper seal and into communication with the equalizing valve prior to the equalizing valve being moved to open position.

Another object of this invention is to provide a well valve of the character described above wherein said outer sleeve is a housing which carries a main valve for controlling flow therethrough and wherein the inner sleeve constitutes an operator tube which moves the main valve between open and closed positions, the operator tube comprising at least two sections telescoped together for limited extensive and retractive movement and having spring means biasing the sections to full extension, the operator tube on downward movement applies a small force to the main valve, but if the main valve offers considerable resistance, the tube will maintain the small bias and contract as a portion of the operator tube continues downwards and opens the equalizing valve, after which, when the pressures across the main valve approach equalization, the operator tube will extend and open the main valve.

Other objects and advantages will become apparent from reading the description which follows and from studying the accompanying drawing, wherein:

DESCRIPTION OF THE PREFERRED EMBODIMENT

Figure 1A:
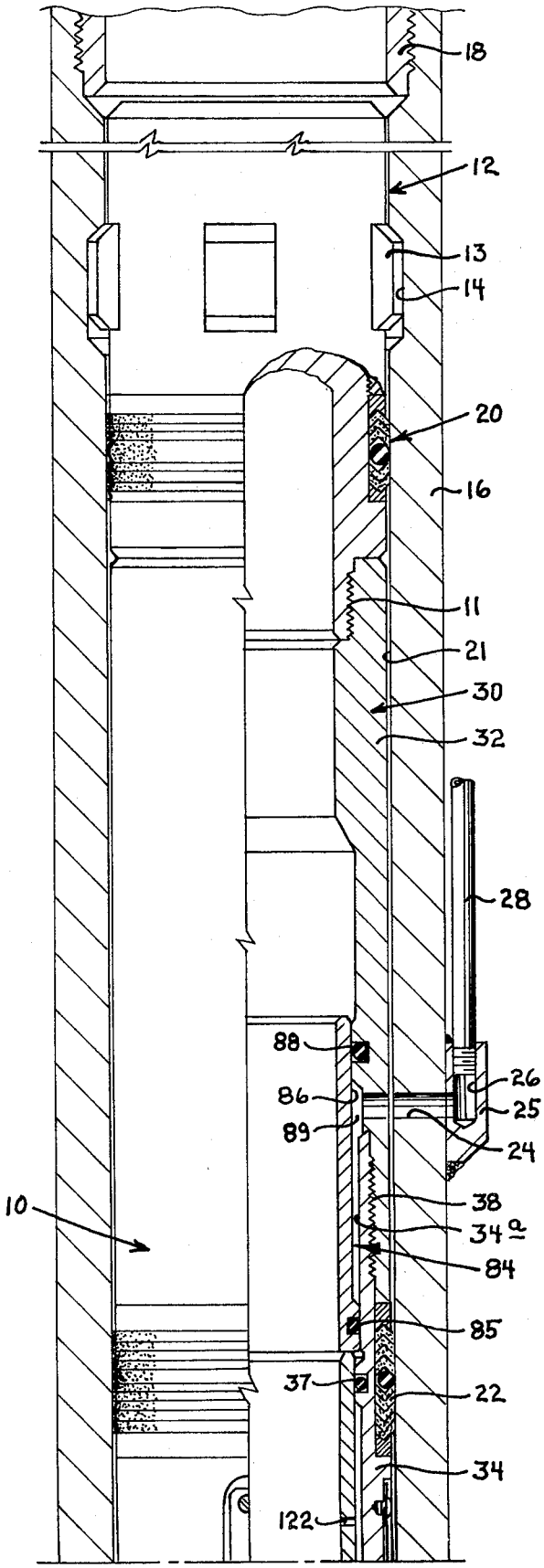
FIGS. 1A and 1B taken together constitute a longitudinal view, partly in section and partly in elevation, with some parts broken away, showing a flow control device or surface controlled subsurface safety valve constructed in accordance with the present invention installed in a well tubing string and showing its main valve in open position.

Referring now to FIGS. 1A through 6, it will be seen that a device constructed in accordance with this invention is illustrated and is indicated generally by the reference numeral 10.

The device 10, as seen in FIGS. 1A through 6, is a well safety valve which is installed in a well by well-known methods such as by wireline and is controlled from the surface by control fluid pressure as will soon be explained. The device or safety valve 10 is attached as by thread 11 to a removable lock device 12 having lugs 13 releasably engaged in a lock recess 14 of a landing nipple 16 made up in the well tubing string 18 and forming a portion thereof. Lock device 12 carries a set of seal rings 20 which sealingly engages the bore wall 21 of landing nipple 16 above the upper end of device or safety valve 10.

The safety valve 10 carries a like set of seal rings 22 which sealingly engages the bore wall of a suitable landing nipple such as landing nipple 16 at a location below lateral port 24. Boss 25 is welded to the exterior of the landing nipple with its L-shaped fluid passage 26 having one if its ends in communication with lateral port 24 of the landing nipple. The other end of passage 26 opens upwardly and receives the lower end of control line 28 which has its upper end (not shown) connected to a surface control unit (not shown) which supplies pressurized control fluid via the conduit 28 to the safety valve 10 to hold it open against the flow of well fluids in the well-known manner. The surface control unit (not shown) is preferably of the usual type having sensors or pilots which are responsive to physical factors such as high or low tubing pressure, high or low flowline pressure, high tank fluid level, platform motion, high temperature, or the like conditions, and which will react to bleed off the control pressure immediately as one of these conditions gets out of acceptable range. This release of control pressure allows the safety valve to close, shutting off further flow therethrough. In this manner, the well is protected even though all of the surface connections may be destroyed and even though the well may be severed at, say, the ocean floor. Such safety valves are generally installed below such depths.

Safety valve 10 comprises a tubular housing 30 made up of an upper sub 32, a packing sub 34, and a spring housing or lower body 36.

The upper sub 32 is attached to the lower end of the lock device as by thread 11 and has its lower end screwed as by thread 38 to the upper end of the packing sub 34, which in turn is connected as by thread 39 to the upper end of the spring housing 36. If desired, this connection may be sealed by a seal ring such as o-ring 39*a*.

Appended to the housing 30 is a lower end piece 40 suspended a spaced distance below the lower end of the spring housing 36 by a pair of control plates 42 and 43 having their upper ends attached to opposing flats 44 and 45 on the spring housing by suitable means such as screws 46 and their lower ends similarly attached to opposing flats 47 and 48, formed on the lower end piece 40, by screws 46.

Figure 1B:
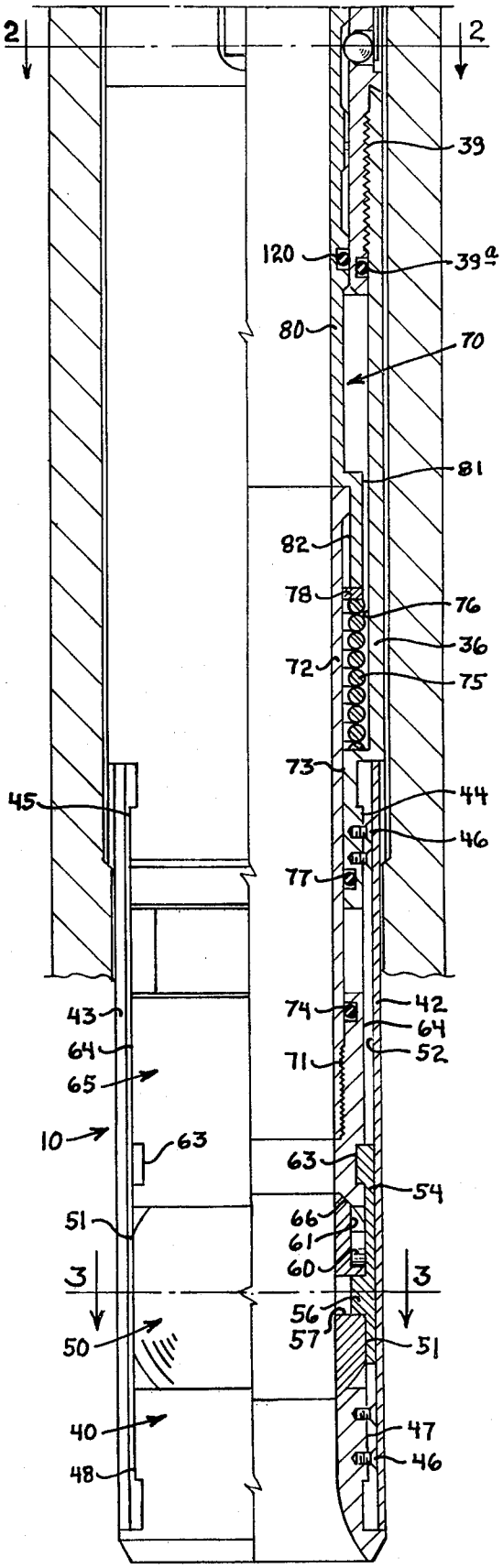

A main valve closure member or ball 50 having opposed flats 51 is disposed between the inner flat sides of control plates 42 and 43, and when the ball is in open position, as shown in FIG. 1B, it rests on the upper end of the lower end piece 40.

The control plates 42 and 43 are each provided with a longitudinal groove 52 formed in their inward face, and a control arm 54 is mounted therein for longitudinal sliding movement. Groove 52 may or may not extend the full length of the control plates. An inwardly projecting pin 56 on the control arm 54 is engaged in a hole 57 centered in the flat 51 of ball 50. As the control arm 54 moves along slot 52 in control plate 42, the ball 50 moves with it.

An inwardly projecting pin 60 is formed on the inward face of each control plate 42 and 43 and is engaged in a radially disposed slot 61 formed in the flat 51 of the ball, and since this pin is stationary, it will impart rotation to the ball as it is moved longitudinally relative to the control plates by the control arms 54.

The control arms 54 each have an inwardly projecting portion 63 at its upper end which is engaged in a transverse groove formed in flats 64 formed on opposite sides of the main seat 65. Main seat 65 has a spherical seat surface 66 surrounding its bore engageable by the spherical outer surface of the ball 50 which controls flow through the main seat as will be explained later.

The main seat 65 forms the lower end of an operator tube 70 and is connected as by thread 71 to the lower section 72 of this operator tube. This connection may be sealed by a seal ring such as o-ring 74. This lower section 72 of the operator tube extends upwardly through the restricted bore 73 of the spring housing 36 and extends up through spring 75 disposed in enlarged bore 76. The lower end of spring 75 rests upon the upwardly facing shoulder provided at the lower end of enlarged bore 76. A seal ring such as o-ring 77 seals between the lower section 72 and the wall of bore 73 of spring housing 36.

An external flange at the upper end of lower section 72 provides a downwardly facing shoulder which is engageable by thrust ring 78 which rests on top of spring 75.

Upper section 80 of the operator tube is enlarged as at 81 at its lower end and is counterbored as at 82, providing downwardly facing shoulder 80*a*. This counterbore 82 receives the upper flanged end of the lower section 72 as shown. The lower end of the upper section 80 is also engageable by the thrust ring 78 which rests atop spring 75. The upper end portion of the upper section of the operator tube 70 is at all times sealingly engaged with resilient seal ring 37 carried in a suitable internal annular recess in the packing sub 34 as shown.

Abutting the upper end of the upper section 80 of the operator tube 70 is the tubular piston 84. Piston 84 in most valves or devices of this type is an integral part of the operator tube. In some devices, the piston not only forces the operator tube down, but it also forces it upwardly. In the device shown, the piston biases the operator tube down only. Therefore, the piston is not necessarily integral with the operator tube. This structure eliminates concentricity problems which may be encountered in manufacturing.

The piston 84 carries a suitable piston seal such as o-ring 85 placed in an external annular groove. The piston 84 is slidable in the housing, the piston seal 85 at all times remaining in sealing contact with the smooth wall 34*a* of the upper portion of the bore of the packing sub 34.

The upper portion of the piston 84 is reduced in outside diameter as at 86 and is provided with a smooth surface which is at all times sealingly engaged with resilient seal ring 88 carried in a suitable internal annular recess formed in the inner wall of top sub 32 as shown.

A variable capacity chamber 89 is formed between the piston 84 and the housing 30 and between the piston ring 85 and the seal ring 88.

The entire operator tube 70 including the piston 84 at its upper end and the main valve seat at its lower end is movable longitudinally in the housing between a lowermost position (shown in FIG. 1) in which the main valve (ball 50) is in full open position and an uppermost position (shown in FIG. 4) in which the main valve is in fully closed position.

Figure 4:
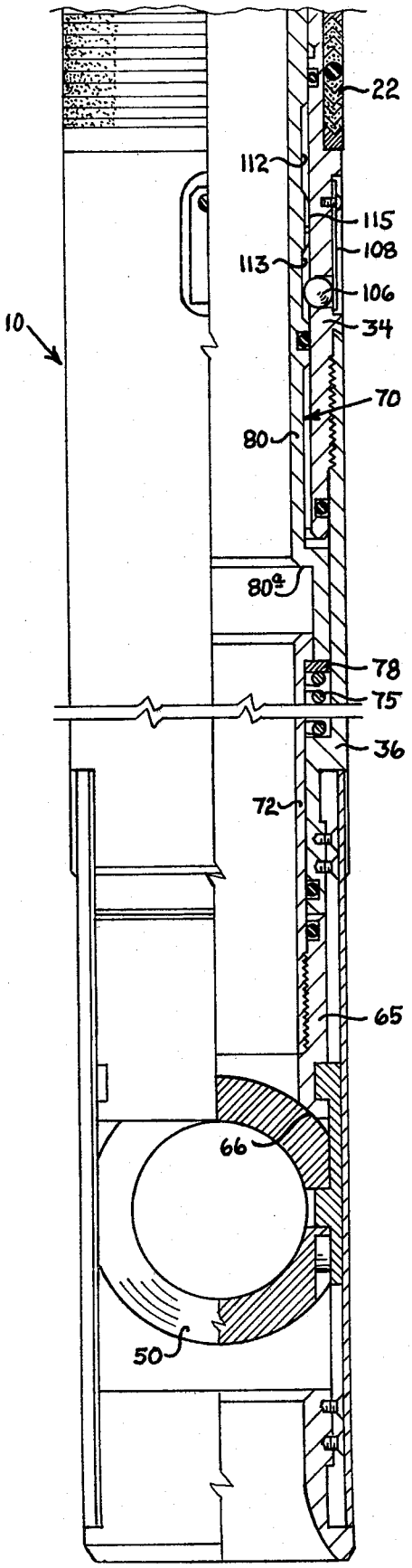
FIG. 4 is a view similar to FIG. 1 showing the device of FIG. 1 in closed position.
Figure 2:
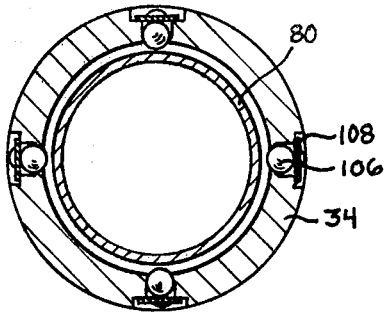
FIG. 2 is a cross-sectional view taken along line 2—2 of FIG. 1.
Figure 3:
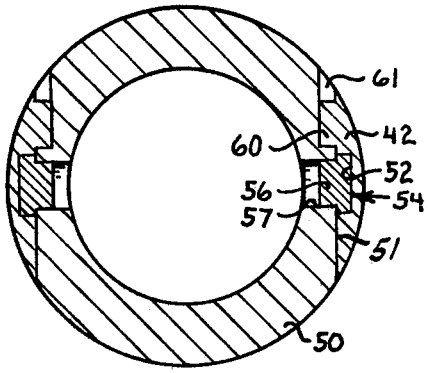
FIG. 3 is a cross-sectional view taken along line 3—3 of FIG. 1.

Spring 75 tends to bias both the upper and lower sections 80 and 72 of the operator tube upwardly and to lift the main ball 50 to its fully closed position shown in FIG. 4.

To hold the main ball 50 in its lower, open position, seen in FIG. 1, pressurized control fluid is conducted to the safety valve 10 from the surface through the control line 28.

Pressurized control fluid is conducted into the variable capacity chamber 89 from control line 28 and acts upon the upper side of that area of the piston defined as the area sealed by piston seal 85 minus that area sealed by seal ring 88. When the pressure of the control fluid is of sufficient magnitude, it will force the piston and the entire operator tube and ball 50 downward, against the force of spring 75, to their lowermost or open position, seen in FIGS. 1A and 1B.

When pressurized control fluid is vented from chamber 89, as would happen in an emergency to which the surface control unit (not shown) responded, spring 75 will be effective to move the operator tube upwards to its uppermost position, lifting ball 50 to its closed position, seen in FIG. 4.

The closed valve precludes flow therethrough and will, thus, maintain the well shut in at its subsurface depth. Since the pressure above the closed ball will bleed down while pressure below it will increase in the well-known manner, the pressure differential across the closed ball will likely become considerable. This differential pressure acts across that area sealed by main seat surface 66. The ball, then, is pressed upwardly against the seat with tremendous force, and it would be very difficult to move to its open position. Added to this force would be the force required to rotate the ball with respect to the main seat in opposition to the friction therebetween resulting from the ball being pressed against the seat with the just-mentioned tremendous force.

To reduce the force required to move the ball to open position and, therefore, reduce wear and tear and possible damage to the operating mechanism, equalizing means are provided for first equalizing pressures across the ball, after which the ball may be moved to open position much more easily.

The equalizing means operates automatically when control pressure is re-established in chamber 89. Control pressure will force the piston down, pushing the upper section 80 of the control tube 70 downwardly. See FIG. 5. As the upper section moves downwardly, its lower end pushing downwardly on thrust ring 78 will compress spring 75 as the lower end of the upper section telescopes down over the upper end of the lower section as far as it will go. This telescoping action is limited by the internal downwardly facing shoulder 80*a* in the upper section 80 engaging the extreme upper end of the lower section 72. The piston 84 will hold the upper section in this equalizing position with the spring compressed and also applying a limited downward bias to the lower section tending to move the ball to open position, but the control pressure may be of insufficient magnitude to open the valve just yet.

Figure 5:
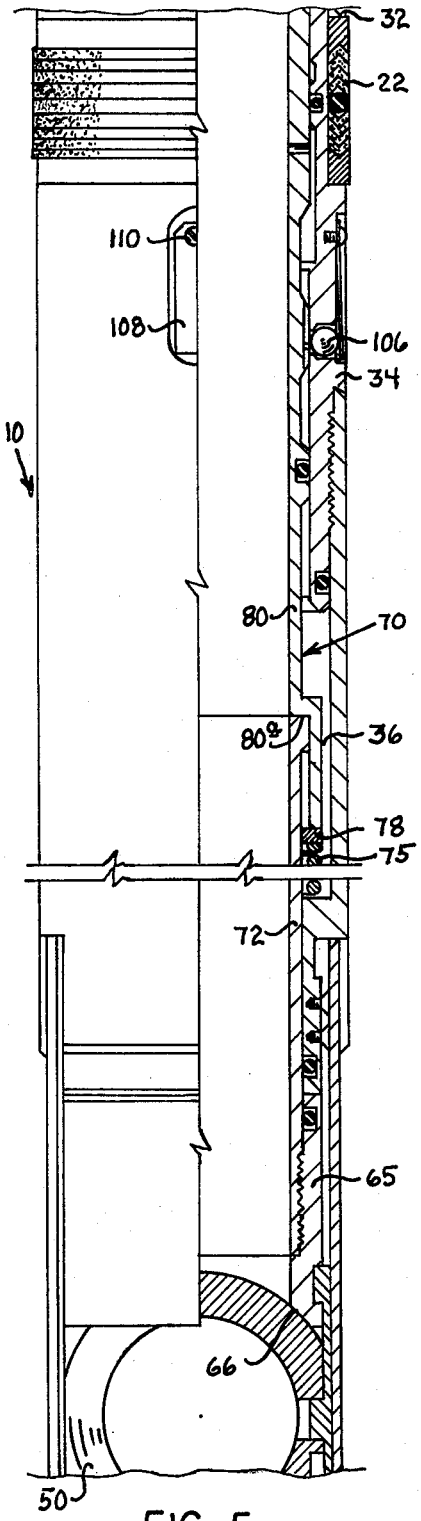
FIG. 5 is a view similar to FIG. 1 showing the device of FIG. 1 with its operator tube in intermediate position in which the equalizing valve is held open.
Figure 6:
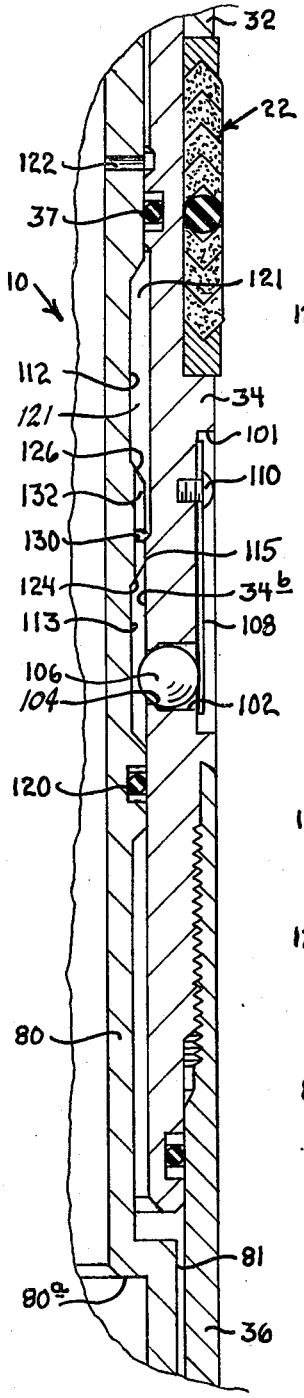
FIG. 6 is a magnified fragmentary view showing the equalizing mechanism of the device of FIGS. 1–4 as it would appear when the main valve is closed.
Figure 7:
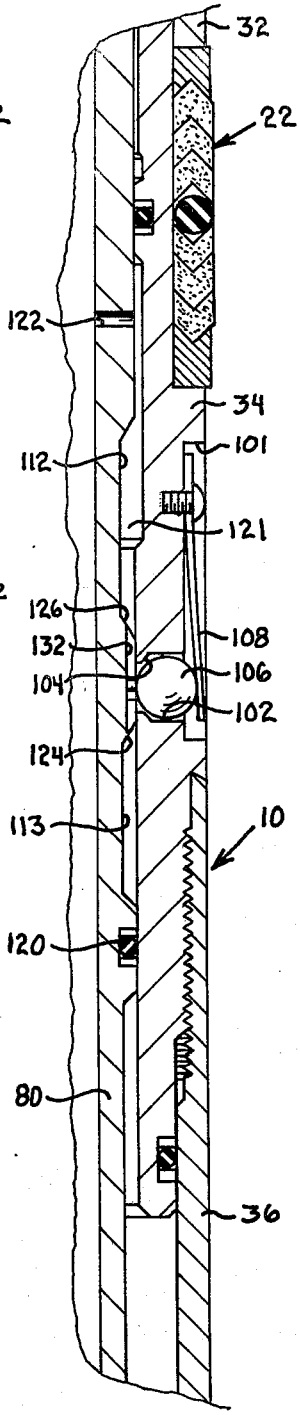
FIG. 7 is a magnified fragmentary view similar to FIG. 5 but showing the equalizing mechanism as it would appear and during the pressure equalization operation.

The equalizing mechanism is shown magnified in FIGS. 6 and 7, FIG. 6 showing the mechanism in valve-closed position (as in FIG. 4) and FIG. 7 showing the mechanism in equalizing position (as in FIG. 5).

Packing sub 34 is provided with at least one lateral vertically extending recess 101, each having an equalizing port 102 and a seat 104 formed therein as shown. Closure means such as ball 106 is disposed in each such equalizing port and is movable between seated and unseated positions. Spring means biases the ball closure towards seat-engaging or closed position. More specifically, flat spring 108 has one of its ends anchored to the packing sub by screw 110. The free end of the spring is at all times engaged with ball 106 biasing it towards closed position. A portion of ball 106 protrudes beyond seat 104 and into the bore 34*b* of the packing sub for a reason soon to be explained.

Upper section 80 of the operator tube 70 is provided with means for unseating ball 106. It will be noted that this upper section 80 as shown is provided with upper and lower external annular recesses 112 and 113, respectively, thus providing a land or flange 115 therebetween.

When the operator tube 70 is in its upper position, as when the safety valve is closed (FIG. 4), the lower recess 113 of the upper section 80 accommodates the ball 106, and the ball remains on seat. When the operator tube is in its lower position, as when the safety valve is open (FIG. 1), the upper recess 112 is opposite the ball 106, and it again remains on seat. Thus, whether the safety valve is open or closed, the equalizing ball 106 remains on seat.

When the operator tube 70, however, is moved to its intermediate or equalizing position (FIG. 5), the land 115 between upper and lower recesses 112 and 113 is in position to hold ball 106 unseated to permit fluid flow from the exterior of the safety valve below packing set 22 into the interior of the housing through equalizing port 102.

It should be noted, however, that when the safety valve is closed and has the well shut in as it would in an emergency, flow cannot take place through the equalizing port 102 and past the ball 106 even if the ball does not seal perfectly with seat 104. This is true because a pair of seal rings are sealingly engaged between the housing and the operator tube above and below the equalizing port. The upper of this pair of seal rings is seal ring 37, previously described. The lower one of this pair of seal rings is seal ring 120 carried in a suitable annular groove formed in the exterior of the upper section 80 as shown. Seal ring 120 seals between the operator tube and the housing below the equalizing port. Thus, even if ball 106 should leak, such leakage would be limited to the pressurization of the annular chamber 121 between seals 37 and 120.

To allow fluid flow from the equalizing valve into the bore of the operator tube, at least one lateral passage 122, and preferably several, is provided in the wall of the upper section 80. When the safety valve is closed, passage 122 is above seal 37 and cannot communicate with the equalizing valve.

When it is desired to open the valve, control pressure is restored. This control pressure acting on piston 84 moves the upper portion of the control tube downward. The lateral passage 122 moves past seal ring 37 before land 115 reaches ball 106. When passage 122 passes seal 37, the pressure between seal rings 37 and 120 will immediately equalize with the pressure in the bore of the operator tube. Of course, as soon as the passage 122 passes seal 37, it is in direct fluid communication with the equalizing valve.

Further downward movement of the upper section 80 brings the downwardly facing cam shoulder 124 on the lower side of land 115 into contact with ball 106, and continued downward movement will cause the ball 106 to be cammed off seat, permitting flow to take place past the ball. The upper portion of the operator tube progresses downwardly until downwardly facing shoulder **80*a* thereof engages the upper end of lower section 72 as seen in FIG. 5. If at this time the differential pressure across the closed ball is negligible, the operator tube will continue downwardly and move the main valve ball 50 to open position. If the pressure differential across the closed ball is great, the operator tube will be arrested in the position shown in FIGS. 5 and 7. In this position, the equalizing valve is held open so that pressured well fluids from exterior of the housing may flow through equalizing port 102, flow around ball 106, move upwardly between the housing and the operator tube, and flow through lateral passage 122 into the bore of the operator tube above the closed main valve. As pressure above the closed main valve is increased, the differential pressure across it will decrease. And, when this differential pressure is reduced sufficiently, the downward bias of piston 84** will become sufficient to move the operator tube to its lowermost position, moving the main valve to its fully open position.

As the operator tube is thus moved downwardly, land 115 which had been holding the equalizing ball unseated to permit equalization of pressures to take place therethrough, will move downwardly past the equalizing ball 106, allowing the flat spring 108 to move ball 106 on seat as the ball is permitted to move inwardly because of the upper recess 112 of the upper section 80 coming into register therewith.

Land 115 needs to be large in diameter in order to unseat the ball 106 a suitable distance. However, if the land is too large, it will restrict bypass flow between it and the inner wall of the housing adjacent equalizing port 102. It is preferable to make land 115 large as shown and provide an external annular groove 130 in it which will register with aperture 102 when the land is in equalizing position as seen in FIG. 7 and with one or more vertical grooves such as groove 132 crossing groove 130 to provide passage for flow of fluids entering the housing through the open equalizing valve. Vertical groove 132 is shown to extend from downwardly facing cam shoulder 124 upwardly to a location above annular groove 130. These fluids flow through seat 104, into groove 130, through slot 132 into the bore of housing 30 and through lateral aperture 122 of the operator tube into the bore of the operator tube.

When control pressure is relieved from chamber 89, the safety valve will be closed as the operator tube is forced to its uppermost position by spring 75. As the operator tube is forced upwardly, cam shoulder 126 forming the upper side of land 115 will cam ball 106 outwardly to open position as the land passes by it. As soon as the land 115 has passed, ball 106 will be returned to its seat by flat spring 108. The ball will be held in its closed position as long as the safety valve remains closed. And, while the safety valve is closed, seal rings 37 and 120 seal above and below the equalizing valve to make the shut-off bubble tight to afford the best protection for the well and to prevent flow cutting of the ball and/or seat.

It is now obvious that when the safety valve is open, as it would be during normal production or operation of the well, the equalizing ball 106 is held on seat by flat spring 108, and this prevents detritis or other matter from lodging between the ball 106 and the seat 104.

It should be understood that the equalizing means just described is operated in response to longitudinal movement of the operator tube relative to the surrounding housing, and while it has been described as being used with a downhole well safety valve which is controlled from the surface where perhaps it finds its greatest utility, it finds utility in many such tools which have a housing with an inner sleeve or operator tube therein for operating a mechanism such as a main valve, or the like, in response to relative longitudinal movement between housing and operator tube, this same relative movement being utilized to operate the equalizing means of this invention automatically when needed.

It should be understood, too, that the equalizing means of this invention is also useful in equalizing devices in which the sole purpose of the inner sleeve in the housing would be to operate the equalizing valve to bring about equalization of pressures in response to longitudinal movement of the inner sleeve as when depressed by an equalizing prong such as may be attached to a pulling tool as is well known. Such equalizing device is illustrated in FIG. 8 and will now be described.

Figure 8:
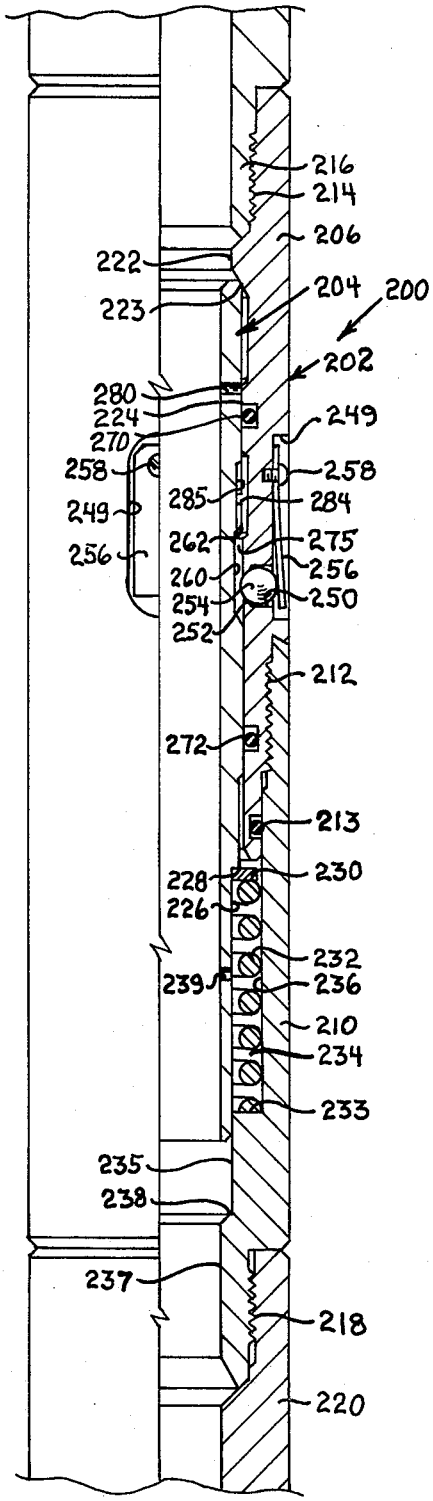
FIG. 8 is a longitudinal view, partly in section and partly in elevation, showing an equalizing sub for well tools constructed in accordance with the present invention.

In FIG. 8, an equalizing sub constructed in accordance with this invention is illustrated and is indicated generally by the numeral 200. It comprises a tubular housing 202 and a tubular operator tube 204 which is mounted therein for longitudinal movement relative thereto.

Tubular housing 202 comprises upper sub 206 and spring housing 210 attached to the lower end thereof as by thread 212. If desired, this connection may be sealed by a resilient seal ring such as o-ring 213.

The upper sub 206 has means such as thread 214 at its upper end for attachment to locking device 216 or other suitable means by which the sub may be anchored in a well flow conductor (not shown). The lower end of spring housing 210 is provided with suitable means such as thread 218 by which a suitable flow control device such as device 220 is attachable thereto. Device 220 may be a safety valve, regulator, plug, or other similar device. Thus, equalizing sub 200 is connectable between a locking device and a flow control device in the well-known manner of equalizing subs to become a part of such assembly.

Locking device 216 with equalizing sub 200 and flow control device attached thereto is installed in the well flow conductor (not shown) and removed therefrom through use of conventional wireline equipment (not shown) including suitable running and pulling tools. The pulling tool preferably includes an equalizing prong for operating the equalizing sub to permit equalization of pressures across the device before releasing the locking device 216 for withdrawal from the well. Otherwise, release of the locking device while a differential pressure acts upwardly thereacross will almost assuredly result in the wireline tools and the device being suddenly thrust upwardly in the well flow conductor, probably causing them to become entangled in the wire and resulting in a costly and time-consuming fishing job. Use of an equalizing prong on the pulling tool will automatically move the operator tube 204 to its lower, equalizing position when the pulling tool engages the locking mandrel. Then, observance of a pressure gauge on the flow conductor at the surface will give indication of when it is safe to release the locking mandrel for withdrawal from the well.

Upper sub 206 has its bore 222 enlarged as at 224 providing a downwardly facing shoulder 223 which limits upward movement of the operator tube 204 in the housing 202 as shown in FIG. 8.

The lower portion of the operator tube 204 is reduced in outside diameter as at 226 providing a downwardly facing shoulder 228. The reduced portion 226 of the operator tube extends downwardly through thrust ring 230 and through coil spring 232 into bore 235 of spring housing 210.

Coil spring 232 is disposed in spring chamber 234 and is supported upon upwardly facing shoulder 233 provided where bore 235 of spring housing 210 is enlarged as at 236. If desired, bore 235 may be reduced as at 237 to provide an upwardly facing shoulder 238 which may serve to ultimately limit downward movement of the operator tube 204 in the housing 202. It is most desirable, however, for this downward movement to be limited instead by the length of the equalizing prong (not shown).

Coil spring 232 biases the operator tube 210 towards its uppermost position seen in FIG. 8. It may be desirable to provide a breather port such as port 239 in the wall of operator tube 204 which will at all times be aligned with the spring chamber 234 to allow free movement of fluids therethrough as may be necessary as the operator tube moves longitudinally in the housing.

Upper sub 206 is provided with at least one and preferably a plurality of external recesses 249, each having an equalizing port 250 with an annular seat surface 252 formed therein as shown. A suitable closure such as ball 254 is disposed in each said equalizing port 250 and is movable therein between seated and unseated positions. A flat spring 256 having one of its ends secured as by screw 258 to the upper sub 206 has its free end engaged with ball 254 and biases it at all times towards seated position as shown. When ball 254 is on seat, a portion thereof projects through the seat 252 and projects into the bore 224 of the upper sub 206. The ball 254 is movable to unseated position by the operator tube in a manner which will soon be explained.

The operator tube 204 is provided with an external annular recess 260 which provides a downwardly facing cam shoulder 262. When the operator tube is in its upper position shown in FIG. 8, the external recess 260 is opposite ball 254 so that the ball may remain seated, closing the port 250. When the operator tube 204 is forced downwardly against the upward bias of spring 232, the downwardly facing cam shoulder 262 is engageable with the ball 254, and further downward movement of the operator tube will cam the ball outwardly to unseated position. When the operator tube is released, spring 232 will force it upwardly to its uppermost position to align external recess 262 with the ball and allow flat spring 256 to return the ball to its seated position to close the equalizing port 250.

It will be noticed that a pair of resilient seal rings such as o-rings 270 and 272, disposed in suitable internal annular grooves in the upper sub 206, seal between the upper sub and the operator tube at all times above and below the ball 254. When the ball 254 is seated, as shown, any leakage therepast will result only in pressurizing the annular space 275 between the seal rings 270 and 272, which is a very limited space, in most cases being less than one cubic inch (11.5 cubic centimeters). Thus, flow is prevented through the equalizing valve which might flow cut or otherwise damage the ball and seat, but even more important, seals 270 and 272 form a bubbletight seal which protects the well as before explained.

The operator tube 204 is provided with at least one and preferably a plurality of lateral passages such as passage 280 formed through its wall as shown. When the operator tube is in its upper position shown, in which the ball 254 is seated, lateral passage 280 is located above seal 270 and cannot communicate with chamber 275 or with equalizing port 250. When, however, the operator tube is depressed, lateral passage 280 is moved downwardly past seal ring 270 to a position of fluid communication with chamber 275 and with equalizing port 250. Immediately as lateral passage 280 passes seal 270, the pressure in chamber 275 is relieved and equalizes with that inside the operator tube. This occurs prior to the time that cam shoulder 262 engages the ball 254.

Continued downward movement of the operator tube brings the downwardly facing cam shoulder 262 into engagement with the inward portion of ball 254, and further downward movement thereon cams the ball off seat, opening the equalizing port. This permits fluid flow to occur from exterior of the device to the interior of the operator tube as flow enters the equalizing port 250, passes around the ball 254 and through the seat 252, into annular chamber 275, and from there through lateral passage 280 of the operator tube 204 into the interior thereof to build up pressure above the device.

The operator tube 204 is preferably formed with exterior groove means as shown in FIG. 8. Such groove means includes an external annular groove such as groove 284 located a spaced distance above downwardly facing cam shoulder 262 so that it will substantially align with equalizing ball 254 when the operator tube 204 is depressed to its lower equalizing position. The groove means also preferably includes at least one vertical groove such as groove 285 extending from downwardly facing cam shoulder 262 upwardly and across annular groove 284 to a location spaced thereabove as shown.

As soon as the depressing force is released from the operator tube, the spring 232 will force the operator tube back up to its uppermost position shown in FIG. 8.

The foregoing description of this invention taken together with the drawings illustrating the different embodiments thereof are here presented by way of explanation only, and various changes in sizes, shapes, and arrangement of parts, as well as certain details of construction, may be made within the scope of the appended claims without departing from the true spirit of the invention.

We claim:

1. A flow control valve for wells, comprising:

a. A tubular housing attachable to a well flow conductor, said housing having a valve seat therein;

b. a main valve closure in said housing movable relative to said valve seat between open and closed positions;

c. valve operator tube means in said housing movable longitudinally between upper and lower positions for moving said valve closure between open and closed positions;

d. equalizing valve means in said tubular housing including an equalizing valve closure movable between closed and open positions and having a portion thereof projecting into the bore of said tubular housing;

e. means on the exterior of said valve operator tube means for engaging said projecting portion of said equalizing valve means and moving said equalizing valve means to open position, comprising a lower recess and an upper recess separated from said lower recess by a land, said land being beveled at its upper and lower sides to provide upper and lower cam shoulders, said upper and lower recesses accommodating the projecting portion of said equalizing valve closure when said valve operator tube means is in its lower and upper positions, respectively, and said land engaging said equalizing valve closure and moving it to open position on downward movement of said valve operator tube means from its upper position;

f. upper and lower seal means sealing between said valve operator tube means and said housing above and below said equalizing valve means; and g. equalizing port means through the wall of said valve operator tube means disposed above said upper seal means when said main valve closure is closed and said valve operator tube means is in its upper position, said equalizing port means being movable past said upper seal means on downward movement of said valve operator tube means to communicate said equalizing port means with said equalizing valve means before said means on the exterior of said valve operator tube means engages and opens said equalizing valve means.

2. The device of claim 1, wherein said equalizing valve closure is a ball disposed in an aperture in said tubular housing, said aperture being formed with an annular seat therein, and a spring biases said ball towards said annular seat.

3. The flow control valve of claim 2, including:

a. an annular groove formed in the exterior of said land a spaced distance above said lower cam shoulder; and b. at least one vertical groove extending from said lower cam shoulder upwardly and across said annular groove to a location spaced thereabove.

4. A well flow control device, comprising:

a. tubular housing means having means at at least one of its ends for attachment to a well flow conductor;

b. main valve closure means in said housing movable between open and closed positions;

c. valve operator tube means in said housing movable longitudinally relative thereto between upper and lower positions, said operator tube means being operatively engageable with said main valve closure means for controlling movement of said main valve closure means from said closed to said open position; and d. equalizing valve means for equalizing pressures across said main valve closure means prior to moving said main valve closure means from said closed towards said open position, said equalizing valve means including:

i. lateral equalizing port means in the wall of said tubular housing means above said main valve means, ii. equalizing valve closure means for controlling flow of fluids through said lateral equalizing port means, said equalizing valve closure having a portion thereof projecting through said port into the interior of said tubular housing means, iii. means on said operator tube means engageable with said equalizing valve closure means for moving said equalizing valve closure means to open position to permit flow of fluids through said lateral equalizing port means, said means for moving said equalizing valve means including external recess means on said valve operator tube means comprising a lower recess and an upper recess separated from said lower recess by a land, said land being beveled at its upper and lower sides to provide upper and lower cam shoulders, said upper and lower recesses accommodating the projecting portion of said equalizing valve closure means when said valve operator tube means is in its lower and upper positions, respectively, and said land engaging said equalizing valve closure means and moving it to open position on downward movement of said valve operator tube means from its upper position, iv. upper and lower resilient seal means sealing between said tubular housing means and said valve operator tube means above and below said lateral equalizing port means of said tubular housing means, and v. lateral equalizing passage means in the wall of said valve operator tube means positioned above said upper resilient seal means when said valve operator tube means is in its upper position, said lateral equalizing passage means being movable to a position below said upper resilient seal means before said shoulder means on said valve operator tube means engages said equalizing valve closure means.

5. The device of claim 4, wherein said equalizing valve closure means is a ball disposed in an aperture in said tubular housing means, said aperture being formed with an annular seat therein, and a flat spring attached to said housing biases said ball towards said annular seat.

6. The flow control valve of claim 5, including:

a. an annular groove formed in the exterior of said land a spaced distance above said lower cam shoulder; and b. at least one vertical groove extending from said lower cam shoulder upwardly and across said annular groove to a location spaced thereabove.

7. A well flow control device, comprising:

a. a housing having a bore therethrough, said housing being attachable to a well flow conductor;

b. a main valve closure member in the housing movable between closed and open positions to control flow therethrough;

c. a collapsible, longitudinally movable operator tube disposed in said housing for moving said main valve closure member between closed and open positions;

d. means for moving said operator tube in a first direction tending to open said main valve closure member;

e. means biasing said operator tube in a second direction opposite said first direction;

f. equalizing valve means openable in response to relative longitudinal movement of said operator tube in said first direction, said equalizing valve means including:

i. external recess means on said operator tube, said external recess means comprising a lower recess and an upper recess separated from said lower recess by a land, said land being beveled at its upper and lower sides to provide upper and lower cam shoulders, said upper and lower recesses accommodating the projecting portion of said equalizing valve closure means when said valve operator tube means is in its lower and upper positions, respectively, and said land engaging said equalizing valve closure means and moving it to open position on downward movement of said valve operator tube means from its upper position, ii. first and second resilient seal means sealing between said operator tube and said housing above and below said external recess means, iii. first lateral equalizing port means in the wall of said housing between said first and second seal means and having a valve seat therein, iv. equalizing valve closure means in said first lateral equalizing port means engageable with said equalizing valve seat and having a portion thereof projecting into the bore of said tubular housing means, said equalizing valve closure means being movable between open and closed positions to control flow through said port, said external recess means on said operator tube being opposite said equalizing valve closure means when said main valve closure member is in closed position, said equalizing valve closure means being movable to open position by engagement of said downwardly facing cam shoulder upon downward movement of said operator tube from its upper position, and v. second lateral equalizing port means in the wall of said operator tube, said second lateral equalizing port means being above said first resilient seal means when said main valve is closed and being movable past said first resilient seal means on downward movement of said operator tube, said second equalizing port means passing said first resilient seal means before said downwardly facing cam shoulder engages said equalizing valve closure means.

8. The device of claim 7, wherein said equalizing valve closure means is a ball, and a flat spring attached to said housing biases said ball towards said seat in said first lateral equalizing port means.

9. The device of claim 7 or 8, wherein said means for moving said operator tube in said first direction in said housing, and said means for biasing said operator tube in said opposite direction include:

a. piston means on the exterior of said operator tube slidingly sealingly engaged with said housing and exposed to fluid pressure conducted to the upper side thereof for moving the operator tube downward in said housing; and b. spring means in said housing supported on an upwardly facing shoulder therein and having its upper end engaged with said operator tube for biasing said operator tube in the opposite direction in said housing.

10. A surface controlled subsurface safety valve adapted to be connected in a well flow conductor to control flow therethrough, comprising:

a. a housing having a bore therethrough and having means thereon for attachment to means anchorable in said well flow conductor;

b. main valve closure means in the bore of said housing movable between open and closed positions;

c. operator tube means in the bore of said housing and longitudinally movable therein for moving said main valve closure means between said open and closed positions;

d. piston means on said operator tube means responsive to control fluid pressure transmitted to one side thereof from the surface for moving said operator tube means in a first longitudinal direction;

e. spring means in said housing biasing said operator tube means in a direction opposite said first direction;

f. pressure equalizing valve means in the wall of said tubular housing openable to permit fluid to bypass said main valve closure means to decrease the pressure differential thereacross to reduce the force required to move said main valve closure means towards open position, said equalizing valve means including:

i. equalizing port means in the wall of said housing and having a seat surface formed therein, ii. an equalizing valve closure in said equalizing port means engageable with said seat surface therein to control flow therethrough, said valve closure having a portion thereof extending through said seat surface and projecting into the bore of said housing, and iii. means biasing said equalizing valve closure towards said seat in said equalizing port means, g. means on said operator tube means engageable with said projecting portion of said equalizing valve closure to move said closure from engagement with said seat upon movement of said operator tube means in said first direction to permit flow through said equalizing port means, comprising a lower recess and an upper recess separated from said lower recess by a land, said land being beveled at its upper and lower sides to provide upper and lower cam shoulders, said upper and lower recesses accommodating the projecting portion of said equalizing valve closure means when said valve operator tube means is in its lower and upper positions, respectively, and said land engaging said equalizing valve closure means and moving it to open position on downward movement of said valve operator tube means from its upper position;

h. an upper resilient seal ring carried in a recess in the wall of said housing bore and sealingly engaging said operator tube means above said equalizing valve means;

i. a lower resilient seal ring carried by said operator tube means and sealingly engaging the inner wall of said housing bore below said equalizing bore; and j. equalizing passage means in the wall of said operator tube means positioned above said upper seal ring when said main valve closure means is closed and movable past said upper seal ring to a position of fluid communication with said equalizing port means of said housing on movement of said operator tube means in said first direction, said lateral equalizing port means of said operator tube means being communicated with said equalizing port means of said housing before said shoulder means on said operator tube means engages said projecting portion of said equalizing valve closure.

11. The device of claim 10, wherein said equalizing valve closure is a ball, and a flat spring attached to said housing biases said ball towards said seat in said equalizing port means.

12. The safety valve of claim 10 or 11, wherein said operator tube means comprises:

a. a lower operator tube section having its lower end engaged with said main valve closure means, said lower section having an external downwardly facing shoulder thereon near its upper end;

b. an intermediate operator tube section having its bore enlarged at its lower end providing an internal downwardly facing shoulder, said intermediate section having its enlarged bore telescoped over the upper end of said lower section, said telescoping connection providing lost motion and rendering said operator tube means extensible and retractable, said downwardly facing internal shoulder of said intermediate section being engageable with the upper end of said lower section, said spring means supported in said housing having its upper end engageable with the lower end of the intermediate section when said operator tube means is retracted and being engaged with both the lower end of the intermediate section and the downwardly facing external shoulder on the lower section when the operator tube means is fully extended, said spring means at all times applying a force to said intermediate section tending to bias said intermediate section upwardly, said intermediate section having said shoulder means formed on its exterior; and c. an upper operator tube section having its lower end abutted with the upper end of said intermediate section, said upper section having said piston formed on its exterior.

13. The flow control valve of claim 12, including:

a. an annular groove formed in the exterior of said land a spaced distance above said lower cam shoulder; and b. at least one vertical groove extending from said lower cam shoulder upwardly and across said annular groove to a location spaced thereabove.

14. A device for use with a downhole well tool for equalizing pressures thereacross, comprising:

a. tubular body having means for attachment in a well tool to become a part thereof, said body having a lateral equalizing port in its wall and an annular seat surface in said port, said body also having a pair of internal seals spaced above and below said port;

b. valve means carried by said body for controlling fluid flow through said port, said valve means including:

i. a valve closure engageable with said seat surface in said port and having a portion extending through said seat surface and into the bore of said tubular body means, and ii. means biasing said valve closure towards seat engaging position to close said port;

c. operator tube means in said body slidable longitudinally relative thereto between upper and lower positions while engaged with said pair of seals, said operator tube means including:

i. downwardly facing shoulder means on said operator tube means for engaging and unseating said valve closure on downward relative longitudinal movement of said operator tube means in said body, ii. external annular groove means formed in the exterior of said operator tube means a spaced distance above said downwardly facing shoulder means and disposed at or near said valve closure when said operator tube means is in its lower position, iii. at least one longitudinal groove formed in the exterior of said operator tube means and extending from said downwardly facing shoulder means to a location spaced above said external annular groove means to allow fluids to freely enter the body through said port, and iv. lateral passage means in the wall of said operator tube means disposed above said pair of sseals when said operator tube means is in its upper position and being disposed between said pair of seals when said operator tube means is in its lower position; and d. means biasing said operator tube means towards its upper position.

15. The equalizing device of claim 14, wherein said lateral passage means and said shoulder means on said operator tube means are spaced relative to the upper one of said pair of seals such that on downward movement of said operator tube means said lateral passage means passes said upper one of said pair of seals before said shoulder means on said operator tube means engages said valve closure.

16. The equalizing device of claim 14, wherein said means biasing said operator tube means upwardly includes: opposed shoulder means on said body and operator tube means and a coil compression spring therebetween biasing said opposed shoulder means away from each other; and said body is further provided with an internal downwardly facing shoulder engageable by said operator tube means to limit its upward movement relative to said body.

17. The equalizing device of claim 16, wherein said shoulder means on said operator tube means for engaging said valve closure and moving it to unseated position is provided by an annular recess formed in the exterior of said operator tube means.

18. The device of claim 14, 16, or 17, wherein said valve closure in said port of said body is a ball having a portion thereof extending inwardly of said annular seat surface and protruding into the bore of said tubular body, and said shoulder means on said operator tube means is inclined downwardly and inwardly for camming said ball outwardly away from said annular seat surface on downward movement of said operator tube means relative to said body.

19. A device for use with a downhole well tool for equalizing pressures thereacross, comprising:

a. tubular body having means for attachment in a well tool to become a part thereof, said body having a lateral equalizing port in its wall and an annular seat surface in said port, said body also having a pair of internal seals spaced above and below said port;

b. valve means carried by said body for controlling fluid flow through said port, said valve means including:

i. a valve closure engageable with said seat surface in said port and having a portion extending through said seat surface and into the bore of said tubular body means, and ii. means biasing said valve closure towards seat engaging position to close said port;

c. operator tube means in said body slidable longitudinally relative thereto between upper and lower positions while engaged with said pair of seals, said operator tube means including:

i. downwardly facing shoulder means on said operator tube means for engaging and unseating said valve closure on downward relative longitudinal movement of said operator tube means in said body, ii. external annular groove means formed in the exterior of said operator tube means a spaced distance above said downwardly facing shoulder means and disposed at or near said valve closure when said operator tube means is in its lower position, iii. at least one longitudinal groove formed in the exterior of said operator tube means and extending from said downwardly facing shoulder means to a location spaced above said external annular groove means to allow fluids to freely enter the body through said port, and iv. lateral passage means in the wall of said operator tube means disposed above said pair of seals when said operator tube means is in its upper position and being disposed between said pair of seals when said operator tube means is in its lower position;

d. means biasing said operator tube means towards its upper position; and e. said lateral passage means and said shoulder means on said operator tube means being spaced relative to the upper one of said pair of seals such that on downward movement of said operator tube means said lateral passage means passes said upper one of said pair of seals before said shoulder means on said operator tube means engages said valve closure.

* * * * *